United States Patent [19]

McKinney

[11] Patent Number: 4,734,301

[45] Date of Patent: Mar. 29, 1988

[54] ARTIFICIAL TREE

[76] Inventor: Nancy E. McKinney, 6206 Sul Ross, Dallas, Tex. 75214

[21] Appl. No.: 843,208

[22] Filed: Mar. 24, 1986

[51] Int. Cl.[4] ..... A47B 37/04; A47G 33/06

[52] U.S. Cl. ..... 428/8; 211/196; 211/197; 211/205; 428/20

[58] Field of Search ..... 108/50; 211/196, 197, 211/205; 428/18, 20, 8, 19; D11/118

[56] References Cited

U.S. PATENT DOCUMENTS

| | | | |
|---|---|---|---|
| D. 269,771 | 7/1983 | Williams | D11/118 |
| D. 276,322 | 11/1984 | Maxwell et al. | D11/118 |
| 735,010 | 7/1903 | Zahl | 428/20 X |
| 2,849,601 | 8/1958 | Walzer | D11/118 X |
| 3,096,943 | 7/1963 | Forrer | 428/19 X |
| 3,284,969 | 11/1966 | Walters et al. | 52/81 X |
| 3,624,732 | 11/1971 | Bowden | 108/50 |
| 3,647,605 | 3/1972 | Spiegel | 428/18 X |
| 3,692,617 | 9/1972 | Marks et al. | 211/205 X |
| 3,746,601 | 7/1973 | Strony | 428/18 |
| 3,871,143 | 3/1975 | Quick | 428/33 X |
| 4,353,659 | 10/1982 | Comte | 108/50 X |

*Primary Examiner*—Henry F. Epstein

*Attorney, Agent, or Firm*—Crutsinger & Booth

[57] ABSTRACT

An artificial tree having a conic frustrum-shaped branch supporting frame with an inner space specially adapted for surrounding an item such as a combination patio table-beach umbrella and thereby adapting it to wintertime use as a decorative artificial tree.

13 Claims, 12 Drawing Figures

ARTIFICIAL TREE

FIELD OF THE INVENTION

This invention relates to artificial trees and more particularly to artificial trees of a decorative type that are especially suitable for use on festive occasions such as Chanukah or Christmas.

BACKGROUND

Many types of artificial trees have previously been proposed. These typically have simulated the natural structure of the tree by including a central vertical trunk to which there have been attached a plurality of branches. These branches have typically been inserted into mating recesses drilled or otherwise formed within a central trunk. If desired, the assembly of the tree is made more or less permanent by glueing.

Since earliest recorded history, it has been the custom in some countries to mark certain festive occasions by erecting within or in immediate proximity to the home, a tree of the evergreen variety. Thus, in modern times, one finds a yule tree present in many homes at the Chanukah or Christmas season.

Unfortunately, many types of evergreens that are attractive for such occasions carry with them potential hazards. These include fire hazards and allergy-producing pollens that are given off by the tree after it is brought indoors. Moreover, in modern urban society, where most of the population does not have available to it its own source of trees, most persons must purchase such trees, and they have become very expensive. Accordingly, artificial decorative substitutes have become increasingly attractive.

It has also become customary for many urban dwellers to have patio furniture or the like, some of which may typically include a rounded table through the center of which vertically projects a beach umbrella, the center post of which may extend to the floor level. In most temperature climates, such patio furniture is unused during the winter months.

BRIEF SUMMARY OF THE INVENTION

This invention provides an improved artificial ornamental tree which departs from the prior art in that it includes a conic frustrum-shaped branch supporting cage-like frame with an inner space specially adapted for surrounding and obscuring from view an item such as a beach umbrella or patio table while adapting it for use as the central part of a decorative artificial tree.

OBJECTS AND FEATURES

It is one general object of the invention to improve artificial decorative trees.

It is another object of this invention to provide such a tree whose physical characteristics are adapted for structural cooperation with those of an existing item such as a patio table or umbrella table.

Accordingly in accordance with one feature of the invention, a conic frustrum-shaped branch supporting cage-like frame is produced which can either stand alone or connect in cooperation structural relationship with an existing furniture item, thus providing enhanced versatility of use.

In accordance with another feature of the invention, the conic frustrum-shaped cage-like frame is formed in a plurality of similar arcuate vertical sections, thus decreasing storage requirements and facilitating manufacture and handling.

In accordance with yet another feature of the invention, the ribs of the cage-like frame are formed and spaced according to a configuration that is adapted for the ready attachment/detachment of branches, thus facilitating assembly and disassembly of the tree.

In accordance with still another feature, a circular adjustable collar is optionally provided at the upper end of the cage-like frame, thereby facilitating engagement with an item such as a beach umbrella.

These and other objects and features will be apparent from the following detailed description of a preferred embodiment, by way of example, with reference to the drawing.

DETAILED DESCRIPTION OF A PREFERRED EMBODIMENT

Figure 1:
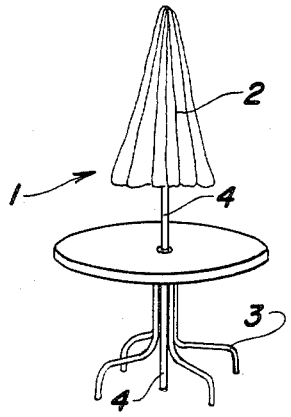
FIG. 1 is a perspective view of a conventional combination patio table and beach umbrella.

Now turning to FIG. 1 of the drawing, it will be observed that it depicts a conventional combination patio table 1 and beach umbrella 2 having three or four legs 3. The umbrella itself typically includes vertical post 4 which conventionally acts as the center of the table and support for the umbrella. This post 4 normally projects downwardly to floor level, although in some instances the post may terminate at the top of the table. However, the principles of this invention are applicable to both. As will be observed, the umbrella is shown in its struck, or non-erected condition.

Figure 2:
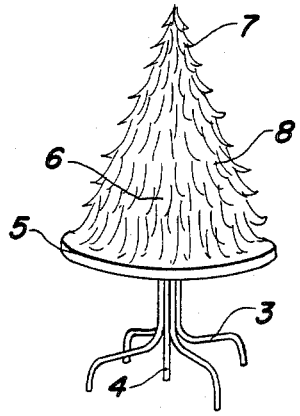
FIG. 2 is a perspective view of a table-top embodiment of the invention.
Figure 3:
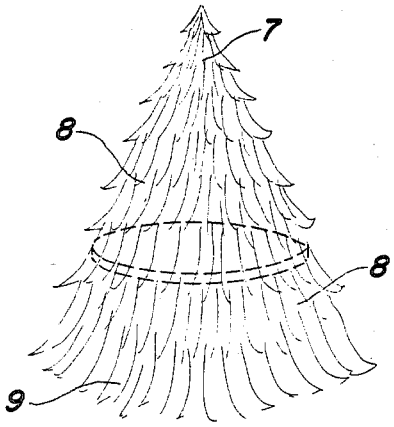
FIG. 3 is a perspective view of a full length embodiment of the invention in which the central umbrella post extends downwardly to the floor level.

FIGS. 2 and 3 depict, respectively, table-top and full length embodiments of the invention. In FIG. 2, Patio table 1 is of the conventional type and typically includes a circular top 5 supported by legs 3. Appearing to rest upon top 5 is tree 6 comprising branches 7 and 8 disposed in conventional evergreen configuration.

FIG. 3 depicts a tree similar to that of FIG. 2 except that since it is full length, the base 9 of the tree rests upon the main surface of the ambient, i.e., the floor of the room, the floor of the patio or the ground.

Figure 4:
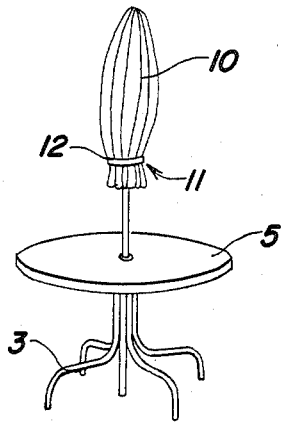
FIG. 4 is a perspective view of a patio table with beach umbrella folded, covered and ready for the improved tree.

FIG. 4 depicts the combination patio table 1 and beach umbrella 2 of FIG. 1 in preparation for use with the structure of this invention. Here, it will be seen, the umbrella has been covered with heavy plastic sheet material 10 (preferably green) which is securely tied at the base 11 by a conventional tie 12. The plastic material and tie may be any of a number of plastic sheeting materials generally available through hardware stores and lumber yards; or, alternatively, it may be a heavy duty conventional plastic trash bag that is wrapped with cord, rubber bands or the like to make it form-fitting over the unerected umbrella. The purpose of the covering is to keep the umbrella material dry and protected from the weather in the event the tree is located outdoors.

Figure 5:
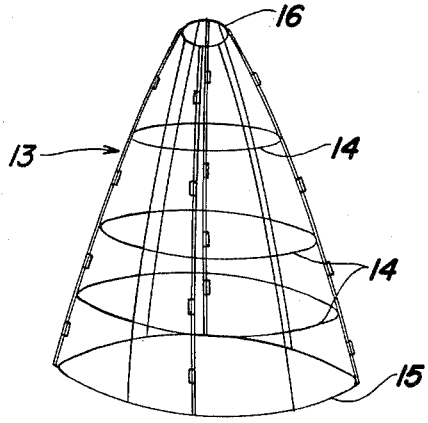
FIG. 5 is a perspective view of the conic frustrum-shaped cage-like frame support according to the invention.

Now turning to FIG. 5, it will be seen that the conic frustrum-shaped cage-like frame 13 of the invention comprises a plurality of spaced, parallel, horizontally disposed rib members 14 positioned between supporting base 15 and optionally adjustable upper collar 16. As is self-evident; the total number of these spaced parallel rib members 14 will vary, depending upon the desired height of the tree, for in addition to imparting strength to the cage, they also include portions (FIG. 12) specially adapted for disengageably attaching artificial branches to the cage so as to produce the artificial tree.

Figure 6:
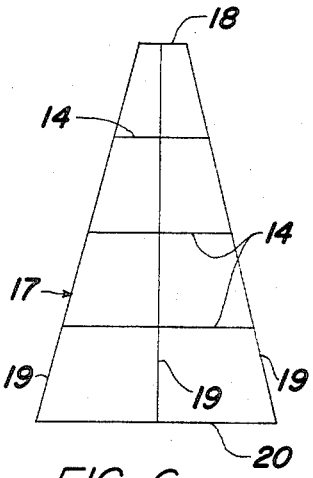
FIG. 6 is one of the four identical arcuate vertical sections which comprise the cage of FIG. 5.

The construction of the frame 13 can better be understood from an inspection of FIG. 6 which depicts one of the four identical arcuate vertical sections 17 that, when assembled, make up the cage-like frame. The section is seen to comprise a plurality of semi-vertically disposed members 19, a plurality of spaced, parallel, horizontally disposed rib members 14, a quarter segment 18 of collar 16, and a quarter segment 20 of base 15. Although in the preferred full-length embodiment of the tree, the frame 13 is made in four vertical sections each approximating 90 degrees of arc, it will be evident that in smaller constructions it may be advantageous for the cage to be construted in three sections each approximating 120 degrees of arc.

Figure 7:
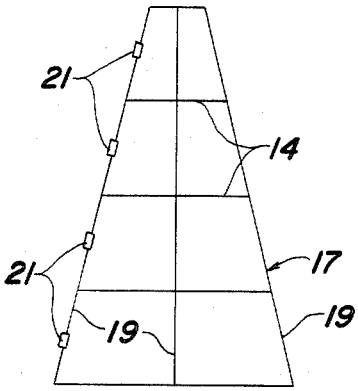
FIG. 7 is a detailed view depicting the configuration of the connecting clips and the spaced parallel members of the cage of FIG. 5.
Figure 8:
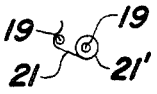
FIG. 8 is a detail showing a preferred form of clip used to assemble the arcuate vertical sections into the conic frustrum shaped frame.

FIGS. 7 and 8 show a preferred form of clip used to assemble the arcuate sections into the frame. In FIG. 7, the clips 21 are shown in the open position when the sections are disassembled; whereas FIG. 8 shows a top view of one of the clips when the semi-vertically disposed members 19 of two adjacent sections are assembled. As will be seen from FIG. 8, a rounded portion 21' of the clip 21 is loosely disposed about the cage member 19, thus allowing the clip to turn freely thereabout. When it is desired to assemble the arcuate vertical sections into the cage-like frame, adjacent semi-vertically disposed sections are brought together side-by-side; and the clips are swiveled around in a hinge-like fashion to capture the adjacent member 19 as shown in FIG. 8. By properly proportioning the tolerances of the spaces within the clips, they are made to be frictionally fitting and will continue in engagement until disengaged manually.

It will be recalled from the description of FIG. 5 that the collar of the frustrum-shaped frame is optionally adjustable. This adjustability may be provided in any of a number of conventional ways. For example, a collar auxiliary device similar to an automobile hose clamp may be provided if it is desired to clamp the collar to the center post of a patio umbrella table. This can be provided as an option for those who wish to provide additional strutural rigidity to the frame when installed.

Figure 9:
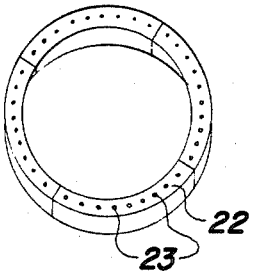
FIG. 9 is a detail showing an alternative construction for the spaced horizontally disposed members of the frame.

For ease in manufacture and optimum costs, the ribs 14 and semi-verticals 19 of the sections are preferably made of suitable strength wire-like materials. Such a construction additionally lends itself to the attachment of branches as is hereinafter described. However, there may be instances in which an alternative construction may be advantageous as, for example, when a desired tree appearance may require branches of greater length or weight. In such case, the spaced parallel members 14 may be made of arcs 22 of ribbon-like material as shown in FIG. 9. As will be observed, these arcs 22 are fitted with a plurality of apertures 23 which are adapted for engagement with portions of the the tree branches as described below.

Figure 10:
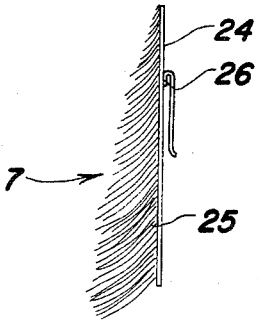
FIG. 10 is a side elevation view of one type of branch according to the invention.
Figure 11:
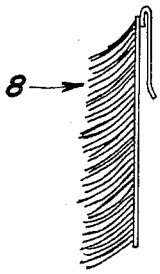
FIG. 11 is a side elevation view of another type of branch according to the invention.

Now turning to FIGS. 10 and 11, it will be observed that the branches 7 and 8 of the tree are depicted. FIG. 10 depicts branch 7 which is especially suited for the top, or crown, of the tree, for branch 7 has an extended part 24 projecting upwardly beyond the main stem 25 thereof. It is part 24 that extends upwardly and inwardly when the topmost branches are in place and which produces the enclosed peak of the tree. As will be observed from the drawings, each of the branches is fitted with a plurality of evergreen-like needles. They may also be fitted out with needle-like green plastic materials or similar materials having a brush-like structure when a bushier appearance is desired. Additionally, although branches 7 are adapted for producing the crown of the tree, a more pronounced peak may be produced by including one or more vertically projecting branches at the crown. To facilitate this, a cap (not shown) may optionally be placed over the upper end of the umbrella.

Figure 12:
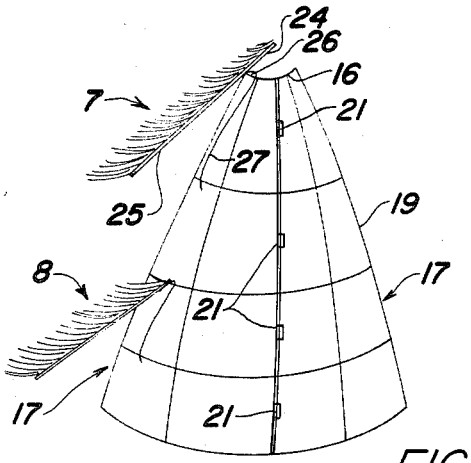
FIG. 12 is a view of the conic frustrum-shaped frame showing the preferred method of installing the tree branches.

FIG. 12 details the preferred way of attaching the tree branches to the cage 13 (only one-half of which is shown for clarity). For the top row, branches 7 are installed by setting them in place with the inner curved part 26 of the branch resting upon a corresponding part of upper collar wire 16 and with the end portion 27 of the branch looping outside the frame and resting against the outer surface of the next lower spaced horizontally-disposed rib member 14 (as shown). The weight of the main stem 25 of the branch is then sufficient to hold the branch in place. The remaining branches are installed in a similar manner, a representative one of branches 8 being shown in FIG. 12 for illustrative purposes.

If, instead of wires, the arcs of ribbon-like material 22 are employed for the spaced horizontally disposed members 14, the branches may be installed by inserting the supporting wire projections of the branches through the apertures provided therefor or they may be looped thereover.

It will now be evident that there has been described herein an improved decorative tree that is relatively easy to assemble and disassemble, occupies a relatively small space for storage, and can serve to adapt a summer umbrella table to a wintertime festive tree.

Although the invention hereof has been described by way of example of a preferred embodiment, it will be evident that other adaptations and modifications may be employed without departing from the spirit and scope thereof. For example, the cage-like frame could be made in a different plurality of vertical sections, or other types of clips or fastening devices could be used to fasten the vertical sections together. Thus, for example, hinges could be employed instead of the clips.

The terms and expressions employed herein have been used as terms of description and not of limitation; and thus, there is no intent of excluding equivalents, but on the contrary it is intended to cover any and all equivlents that may be employed without departing from the spirit and scope of the invention.

What is claimed is:

1. A trunkless artificial ornamental tree adapted for seasonal disassembled storage comprising a conic frustrum-shaped cage-like frame having a plurality of vertical frame sections which when joined together form said frame, each said vertical frame sections including a plurality of spaced parallel generally horizontally disposed rib members and a plurality of semi-vertically disposed members; means for joining said vertical frame sections together to form said frustrum shaped frame; a plurality of artificial tree branches each having a main longitudinal stem and a plurality of needles or brush-like members attached to said stem; and means for removably attaching said tree branches at predetermined spaced locations on said cage-like frame thereby to produce the appearance of an ornamental tree.

2. An artificial ornamental tree according to claim 1 in which each of said plurality of vertical frame sections is arcuate and encompasses a 90° circumferential arc of said frustrum shaped frame.

3. An artificial ornamental tree according to claim 1 in which said means for joining said vertical frame sections together comprises a plurality of metal clips.

4. An artificial ornamental tree according to claim 1 in which said means for joining said vertical frame sections together comprises a plurality of disengageable hinges.

5. An artificial ornamental tree according to claim 1 in which said spaced generally horizontally disposed parallel members further include portions adapted for engagement with said tree branches thereby to support said branches when in place.

6. An artifical ornamental tree according to claim 5 in which said spaced generally horizontally disposed parallel members further include apertures specially adapted for engagement with extensions of the stems of said tree branches.

7. An artificial ornamental tree according to claim 5 in which each of said tree branches includes an extension of the main longitudinal stem, said extensions including portions adapted for detachable engagement with said spaced parallel generally horizontally disposed members.

8. An artificial ornamental tree according to claim 7 in which certain of said extensions each include portions adapted for engagement with two of said spaced parallel generally horizontally disposed members.

9. An artificial ornamental tree according to claim 1 in which each of said vertical frame sections includes a collar portion adapted for adjustable engagement with an essentially circular vertical supporting member.

10. In combination, a patio umbrella table having an essentially planar table surface, a plurality of legs for supporting said table surface and an umbrella with a central post projecting upwardly of said table surface, a conic frustrum-shaped cage-like frame surrounding said umbrella and engaging said central post, said frame having a plurality of vertical frame sections each section including a plurality of spaced paralle generally horizontally disposed members and a plurality of semi-vertically disposed members joining said spaced parallel members, a plurality of artificial tree branches each having a main longitudinal stem and a plurality of needles or brush-like members attached to said stem; and means for removably attaching said tree branches at predetermined spaced locations on said frame to produce the appearance of an ornamental tree, whereby said frame and said branches are adapted for seasonal disassembled storage.

11. The combination according to claim 10 in which said central post projects downwardly to floor level.

12. The combination according to claim 10 in which said frustrum-shaped cage-like frame includes a skirt portion adapted for engagement with and support by said table surface.

13. The combination according to claim 10 in which said frustrum-shaped cage-like frame is the full length of the said patio umbrella table and said post and thereby surrounds said table completely.

* * * * *

UNITED STATES PATENT AND TRADEMARK OFFICE

CERTIFICATE OF CORRECTION

PATENT NO. : 4,734,301

DATED : March 29, 1988

INVENTOR(S) : Nancy McKinney

It is certified that error appears in the above-identified patent and that said Letters Patent is hereby corrected as shown below:

In Column 6, line 24, change "paralle" to -- parallel -.

Signed and Sealed this

Nineteenth Day of July, 1988

*Attest:*

DONALD J. QUIGG

*Attesting Officer*

*Commissioner of Patents and Trademarks*